United States Patent [19]

van Rinsum

[11] Patent Number: 4,506,635

[45] Date of Patent: Mar. 26, 1985

[54] VALVE CONTROL FOR A RECIPROCATING PISTON INTERNAL COMBUSTION ENGINE

[75] Inventor: Cornelis van Rinsum, Kressbronn, Fed. Rep. of Germany

[73] Assignee: MTU-Motoren- Und Turbinen-Union Friedrichshafen GmbH, Friedrichshafen, Fed. Rep. of Germany

[21] Appl. No.: 588,783

[22] Filed: Mar. 12, 1984

[30] Foreign Application Priority Data

May 31, 1983 [DE] Fed. Rep. of Germany ..... 3319637

[51] Int. Cl.[3] ..... F01L 1/26

[52] U.S. Cl. ..... 123/90.22; 123/90.4; 123/90.43; 123/90.46

[58] Field of Search ..... 123/90.39, 90.4, 90.43, 123/90.45, 90.46, 90.22

[56] References Cited

U.S. PATENT DOCUMENTS

| | | | |
|---|---|---|---|
| 1,198,155 | 9/1916 | Schenker | 123/90.4 |
| 1,223,762 | 4/1917 | Bugatti | 123/90.22 |
| 1,842,426 | 1/1932 | Salisbury | 123/90.22 |
| 2,521,176 | 9/1950 | Kutz | 123/90.46 |
| 3,208,440 | 9/1965 | Portmann | 123/90.4 |

FOREIGN PATENT DOCUMENTS

| | | | |
|---|---|---|---|
| 2422204 | 11/1975 | Fed. Rep. of Germany | 123/90.4 |
| 369284 | 4/1973 | U.S.S.R. | 123/90.4 |

*Primary Examiner*—Ira S. Lazarus
*Assistant Examiner*—R. S. Bailey
*Attorney, Agent, or Firm*—Craig & Burns

[57] ABSTRACT

In a valve control, at least two valves (16, 17) per cylinder head (11) are actuated in unison by a cross member (18) moved by a rocker arm (13). The rocker arm (13) and a guide member (15) are pivotally connected with the cross member (18) and form a parellelogram for the rectilinear guidance of the cross member (18). The valve clearance compensation and the accurate abutment of the cross member (18) at both valve stems is attained by adjustment of the fixed points of rotation of rocker arm (13) and guide member (15). Adjustable eccentrics are arranged in the points of rotation, which cooperate with at least one automatic adjusting mechanism (28, 30). The eccentricities (23, 26) of the two eccentrics are disposed perpendicular to one another in the starting position. During the entire operating period, freedom from clearance and a constant control geometry are assured for the valve control.

20 Claims, 3 Drawing Figures

VALVE CONTROL FOR A RECIPROCATING PISTON INTERNAL COMBUSTION ENGINE

The present invention relates to a valve control for a reciprocating piston internal combustion engine in which a rocker arm is rotatably supported at the cylinder head on a shaft retained by bearing supports and in which two valves are actuated in unison by a cross member movably connected with the rocker arm and a guide member. A commonly actuated valve pair requires mechanisms, by means of which the synchronism of the opening and closing movements of both valves is adjustable.

Such a valve control is known for a reciprocating piston internal combustion engine according to the catalog M 6000 of Maybach-Motorenbau GmbH. dated July 1962. By adjusting the valve control during the installation to a certain valve clearance between the cross member and the two valve stems, the synchronism of the valve movements is approximately achieved thereby. After completion of the adjusting work, the mechanisms are secured against any automatic adjustment during the operation.

As a result of wear and deposits, however, the clearance originally existing between valve stem and cross member changes during the operation. As a rule an uneven increase of the valve clearance at the two commonly actuated valves results therefrom. As a consequence, an increasing phase displacement in the movement sequence of the valves will take place in the course of the operation. The valve which has the larger clearance with respect to the cross member thereby lags or limps behind the other valve during the opening. As a result thereof, it is torn open with higher velocity compared to the leading valve. Large acceleration forces result therefrom which lead to excessive loads and stresses endangering the operation and to increased wear in the valve control.

It is now the object of the present invention to provide a valve control, by means of which a control geometry which remains the same during the operation is achieved for valves actuated pairwise by a cross member guided by a parallelogram.

The underlying problems are solved according to the present invention in that the points of rotation of the rocker arm and of the guide member arranged at the bearing supports are each constructed to be individually adjustable by eccentrics, in that at least one automatic adjusting mechanism cooperates with the eccentrics of the points of rotation and in that the eccentricities of the two eccentrics are disposed at right angle to one another in the starting position.

The advantages achieved with the present invention reside in particular in that by the displacement of the clearance adjusting devices into the fixed part of the valve control, the moved masses are reduced, in that a space-saving arrangement results by the combination of the adjusting mechanisms for the valve clearance compensation and cross member position and in that the harmful additional loads and stresses in the valve control are avoided which heretofore resulted necessarily from wear-conditioned changes of the control geometry.

These and other objects, features and advantages of the present invention will become more apparent from the following description when taken in connection with the accompanying drawing which shows, for purposes of illustration only, one embodiment in accordance with the present invention, and wherein:

FIG. 3 is a cross-sectional view of the valve control taken along line III—III of FIG. 1.

Figure 1:
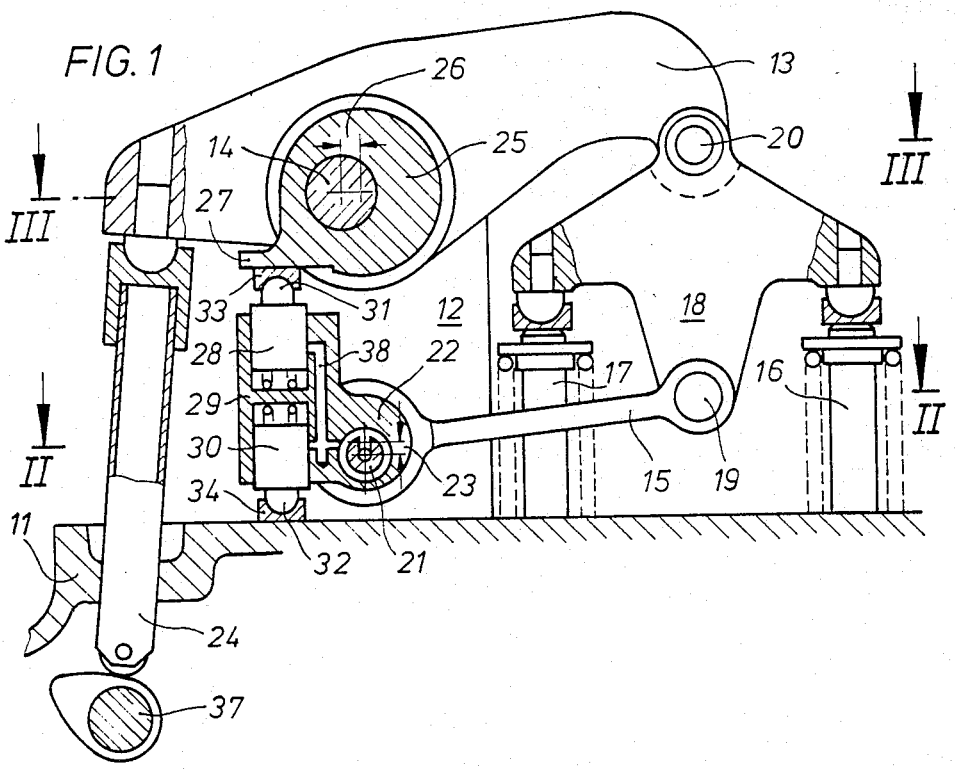
FIG. 1 is a cross-sectional view of a valve control in accordance with the present invention, taken along line I—I of FIG. 2.
Figure 2:
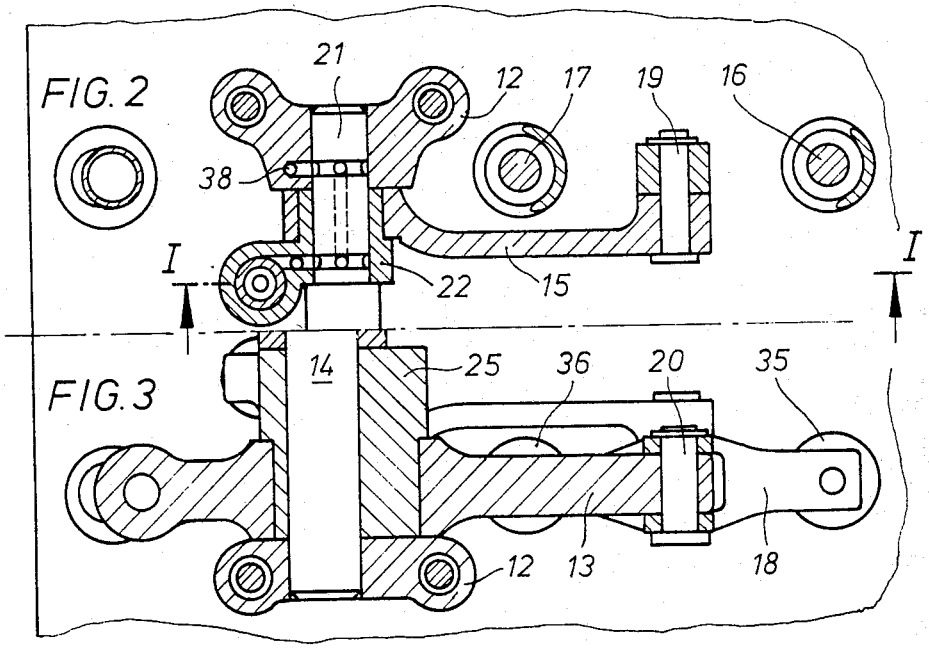
FIG. 2 is a cross-sectional view of the valve control taken along line II—II of FIG. 1.

Referring now to the drawing wherein like reference numerals are used throughout the various views to designate like parts, a valve control for a reciprocating piston internal combustion engine consists of a rocker arm 13 that is driven from a cam shaft 37 by way of a push rod 24 and of a cross member 18 pivotally connected with the rocker arm 13 at the point of rotation 20 for the common actuation of the valves 16 and 17. The rocker arm 13 is pivotally supported at the cylinder head 11 on a shaft 14 retained by bearing supports 12 under interposition of a bush 25. The center of the shaft 14 is arranged in the bush 25 offset by the eccentricity 26 with respect to the center of the rocker arm bearing support. The bush 25 includes a lever-like radial extension 27 which cooperates with an adjusting mechanism 28 by way of a ball joint 31 and a slide member 33.

A guide member 15 arranged parallel to the rocker arm 13 is pivotally connected at one of its ends with the cross member 18 in a point of rotation 19 and is supported between the bearing supports 12 on a shaft 21 under interposition of a bush 22. The center of the shaft 21 is arranged in the bush 22 offset by the eccentricity 23 with respect to the center of the guide arm bearing support. The bush 22 includes a lever-like radial extension 29 which is constructed for the mounting of the adjusting mechanism 28 and of a further adjusting mechanism 30. The further adjusting mechanism 30 cooperates with a surface at the cylinder head 11 by way of a ball joint 32 and a slide member 34.

The eccentricity 26 in the bush 25 is disposed in the starting position approximately perpendicularly to the actuating direction of the valves 16 and 17. As a result thereof, a slight rotation of the bush 25 causes a displacement of the center of the rocker arm bearing support approximately in parallel to the actuating direction of the valves 16 and 17, from which also follows a displacement of the cross member 18. The direction of the displacement is thereby dependent on the direction of the bush rotation. In the valve control illustrated in FIG. 1, the bush 22 is so rotated by the adjusting mechanisms 28 and 30 that a clearance reduction occurs between the cross member 18 and the valve stem ends of the valves 16 and 17.

The rocker arm 13 and the guide member 15 form a parallelogram for the rectilinear guidance of the cross member 18. The movement for the clearance reduction between cross member 18 and valve stem ends of the valves 16 and 17 which originates from the adjusting mechanism 28, terminates when the cross member 18 has come into abutment at the higher of the two valve stem ends. More particularly, by reason of the rectilinear guidance by the rocker arm 13 and guide member 15, the cross member 18 cannot tilt down to the lower valve stem end as long as a second point of rotation of the parallelogram is not adjusted.

This adjustability of the second point of rotation is obtained in the illustrated embodiment by means of the bush 22. In the starting position, the eccentricity 23 at the bush 22 is disposed approximately parallel to the actuating direction of the valves 16 and 17. A slight rotation of the bush 22 causes thereby a displacement of the guide arm center transversely to the actuating direction of the valves 16 and 17. The aforementioned possibility for the tilting down of the cross member 18 onto the lower valve stem is thus given.

With a displacement of the center of the guide arm bearing support by a rotation of the bush 22, the adjusting mechanisms 28 and 30, which are coaxially arranged in the extension 29, will also undergo a pivoting about the shaft 21. Oppositely directed displacements between slide member 33 and extensions 27 as well as between slide member 32 and cylinder head 11 result therefrom. The change in length between the abutment surfaces of the slide members 32 and 33 which result from the pivoting of the adjusting mechanisms 28 and 30, are automatically compensated by the adjusting mechanisms. The pressure oil required for the functioning of the adjusting mechanisms 28 and 30 is supplied from the lubricating oil circulation of the reciprocating piston internal combustion engine by way of the bores 38 in the bearing support 12, shaft 21 and bush 22. The adjusting mechanisms 28 and 30 may be constructed corresponding to the German Pat. No. 949,852.

The cylinder head 11 of the illustrated embodiment is equipped with four valves 16, 17 and 35, 36 which are respectively actuated in unison pairwise. The valve control for the valves 35, 36 is constructed identically but mirror-image-like or symmetrically to the valve control of the valves 16, 17 described hereinabove. Consequently, the illustration in FIG. 3 also applies for the valves 16 and 17 and vice versa.

While I have shown and described only one embodiment in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. A valve control for a reciprocating piston internal combustion engine with a cylinder head, comprising a rocker arm means, bearing support means, pivotal connecting means including a shaft retained by the bearing support means for rotatably supporting the rocker arm means at the cylinder head, two valves, a cross member for actuating said two valves in unison, guide arm means, said rocker arm means and guide arm means being pivotally connected with said cross member, said guide arm means being arranged substantially parallel to the rocker arm means between a pivotal connecting means at the bearing support means and the pivotal connection at the cross member, the points of rotation of the pivotal connecting means of the rocker arm means and of the guide arm means at the bearing support means being each individually adjustable by an eccentric means, an automatic adjusting means cooperating with the eccentric means, and the eccentricities of the two eccentric means being disposed substantially perpendicularly in the starting position.

2. A valve control according to claim 1, wherein the adjustable points of rotation of the pivotal connecting means of the rocker arm means and of the guide arm means each include a bush means pivotally arranged on a fixed shaft, with the center of the shaft and the center of the respective point of rotation being offset eccentrically to one another.

3. A valve control according to claim 2, wherein each bush means includes a lever-like, substantially radial extension.

4. A valve control according to claim 3, wherein the eccentricity at the bush means in the pivotal connecting means for the rocker arm means is disposed in the starting position approximately perpendicularly to the actuating direction of the valves.

5. A valve control according to claim 4, wherein the lever-like extension and the eccentricity of the bush means of the pivotal connecting means of the rocker arm means are arranged approximately in parallel.

6. A valve control according to claim 5, wherein the eccentricity at the bush means in the pivotal connecting means for the guide arm means is disposed in the starting position approximately in parallel to the actuating direction of the valves.

7. A valve control according to claim 6, wherein the lever-like extension and the eccentricity of the bush means of the pivotal connecting means of the guide arm means are arranged approximately perpendicular to one another.

8. A valve control according to claim 7, wherein the automatic adjusting means is arranged in the lever-like extension of the bush means of the pivotal connecting means of the guide arm means.

9. A valve control according to claim 8, wherein the operating direction of the automatic adjusting means extends approximately parallel to the actuating direction of the valves.

10. A valve control according to claim 9, wherein the automatic adjusting means is constructed variable in length and on the one hand cooperates with the lever-like extension of the bush means of the pivotal connecting means of the rocker arm means and, on the other, is supported at the cylinder head.

11. A valve control according to claim 10, wherein the automatic adjusting means includes two coaxially arranged pistons acted upon with pressure oil independently of one another.

12. A valve control according to claim 2, wherein the eccentricity at the bush means in the pivotal connecting means for the guide arm means is disposed in the starting position approximately in parallel to the actuating direction of the valves.

13. A valve control according to claim 12, wherein the lever-like extension and the eccentricity of the bush means of the pivotal connecting means of the guide arm means are arranged approximately perpendicular to one another.

14. A valve control according to claim 2, wherein the automatic adjusting means is arranged in the lever-like extension of the bush means of the pivotal connecting means of the guide arm means.

15. A valve control according to claim 14, wherein the operating direction of the automatic adjusting means extends approximately parallel to the actuating direction of the valves.

16. A valve control according to claim 15, wherein the automatic adjusting means is constructed variable in length and on the one hand cooperates with the lever-like extension of the bush means of the pivotal connecting means of the rocker arm means and, on the other, is supported at the cylinder head.

17. A valve control according to claim 16, wherein the automatic adjusting means includes two coaxially arranged pistons acted upon with pressure oil independently of one another.

18. A valve control according to claim 1, wherein the operating direction of the automatic adjusting means extends approximately parallel to the actuating direction of the valves.

19. A valve control according to claim 2, wherein the automatic adjusting means is constructed variable in length and on the one hand cooperates with the lever-like extension of the bush means of the pivotal connecting means of the rocker arm means and, on the other, is supported at the cylinder head.

20. A valve control according to claim 1, wherein the automatic adjusting means includes two coaxially arranged pistons acted upon with pressure oil independently of one another.

* * * * *